United States Patent [19]

Milner

[11] Patent Number: 4,796,891

[45] Date of Patent: Jan. 10, 1989

[54] MUSICAL PUZZLE USING SLIDING TILES

[75] Inventor: Ronald E. Milner, Grass Valley, Calif.

[73] Assignee: Applied Design Laboratories, Inc., Grass Valley, Calif.

[21] Appl. No.: 9,961

[22] Filed: Feb. 2, 1987

[51] Int. Cl.[4] ..... A63F 9/08

[52] U.S. Cl. ..... 273/153 S; 273/238; 273/340

[58] Field of Search ..... 273/153 S, 237, 238, 273/1 E, 1 GC; 434/340, 341

[56] References Cited

U.S. PATENT DOCUMENTS

| | | | |
|---|---|---|---|
| 4,023,807 | 5/1977 | Santianni | 273/238 |
| 4,285,517 | 8/1981 | Morrison | 273/1 GC |
| 4,323,243 | 4/1982 | Hanson et al. | 273/153 S |

*Primary Examiner*—Maryann Lastova

*Attorney, Agent, or Firm*—Townsend and Townsend

[57] ABSTRACT

A puzzle of the type having an array of movable tiles enclosed and supported by a frame structure includes circuitry for producing sound to identify each of the tiles. Each tile is formed with contact terminals formed on a surface that confronts a support surface of the frame. The support surface defines a number of predetermined locations at which the tiles can be positioned, each location being provided with contact terminals connected to the sound-producing circuitry. Each of the tiles is equipped with spring biasing so that when a tile is properly positioned at one of the predetermined locations and depressed, the contact terminals of the tile and the location are brought together. Each tile is provided with some electrical characteristic that causes a tone to be produced, identifying the tile.

18 Claims, 3 Drawing Sheets

MUSICAL PUZZLE USING SLIDING TILES

BACKGROUND OF THE INVENTION

The present invention is directed to puzzles, and more particularly to the type of puzzle having an array of movable elements capable of being positioned and arranged in a number of configurations. More specifically the invention provides sound-producing apparatus in conjunction with the puzzle capable of being activated by the movable elements to produce a tone that identifies each movable element solely by the sound it causes the sound-producing apparatus to produce.

Among the wide variety of puzzles available to allow one to while away his or her time, one has enjoyed relatively continuous popularity over the years, and has been the subject of a variety of modifications. This one such type of puzzle is formed from a frame structure that includes a support surface upon which a plurality of substantially square tiles are moved from one location to another, to arrange the tiles in predetermined arrays according to visual indicia identifying the tiles. An example of such a puzzle can be seen in U.S. Pat. No. 4,493,487.

Typically puzzles of the foregoing type are provided with indicia of one type or another identifying each tile, such as, for example, numbering each tile 1–15. The puzzle is used by moving the tiles from one (usually disoriented) configuration to another dictated in some logical fashion by the identifying indicia. This, it can be seen, limits the number of useful logical, configurations. Puzzles of this type, i.e., those with strong visual cues, are easy to master and quickly lose their appeal. Further, insofar as is known, no such puzzle of this type has the capability of identifying the tiles by audio means rather than visual means.

SUMMARY OF THE INVENTION

Accordingly, in its broadest scope, the present invention provides a puzzle of the type having parts movable into a number of locations the parts being identifiable by sound rather than numbers. The invention can be inexpensively constructed, and challenging to use.

According to a preferred embodiment of the invention, therefore, a frame structure, having a planar support surface, encloses an array of tiles mounted for movement on the support surface into a number of configurations. Housed within the frame is a tone-generator that is connected to pairs of contact terminals formed on the support surface at each of a number of predetermined locations at which the tiles can be positioned. In this preferred embodiment, the sound generator is constructed to produce tones. In an alternate embodiment described more fully below, the sound generator is constructed to produce speech.

Each tile is equipped with an electrical resistor that is connected to contacts located on a surface of the tile that confronts the support surface, and positioned to be registered with the pairs of contact elements of a location when the tile is positioned thereat. The tile is further structured to be depressed to bring its contact elements into touching engagement with pairs of the contact terminals to place the resistor in circuit with the tone generator. This activates the tone generator, causing it to produce a tone of a pitch, corresponding to a note of musical scale, that is determined by the resistor and identifies the particular tile.

Since each tile can be described by the tone it generates when its associated resistor is placed in circuit with the tone generator, the tile need not be labeled with any visual identification. The object of the puzzle therefore, is to arrange the tiles in an ordered configuration on the support surface to play a song or other procession of notes when each tile is depressed in a sequential order.

In an alternate embodiment of the invention mentioned above, the sound generator is configured to produce speech. The individual tiles, in this embodiment, are configured (i.e., coded) in a manner recognizable by a decoder associated with the sound generator, so that each tile can produce, when depressed, a word indigenous to that tile. In this embodiment the tiles can be properly arranged so that when depressed in a particular manner (left to right, top to bottom, for example) a sentence or sentences can be produced.

There are a number of advantages readily apparent. First, the puzzle is much more challenging using aural identification, as opposed to visual identification. locating the tiles in pre-arranged order. The variety of arrangements is significantly increased since the arrangement can be made to produce a variety of tunes, which cannot be done when the tiles are identified by, for example, numbers.

These and other advantages and features of the invention will become readily apparent to those skilled in the art, upon a reading of the following detailed description of the invention, which should be taken in conjunction with the accompanying drawings.

DETAILED DESCRIPTION OF THE INVENTION

Figure 1:
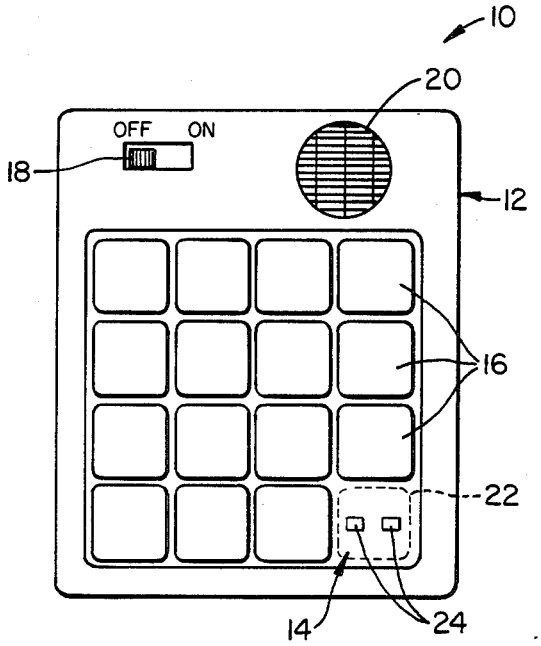
FIG. 1 is a view of the puzzle constructed according to the teachings of the present invention. illustrating an array of tiles mounted in and enclosed by a frame structure.

Referring first to FIG. 1, illustrated therein is a puzzle, designated generally with the reference numeral 10, constructed in accordance with the teachings of the present invention. As illustrated, the puzzle 10 includes a frame structure 12 having a substantially planar support surface 14 for enclosing and holding an array of substantially rectangular (square) tiles 16. An on/off switch 18 may be included, as well as a speaker aperture 20.

As will be seen, each of the tiles 16 is formed to interlock with each of the other tiles in a manner that does not inhibit movement, but tends to hold the array together. The tiles 16 are movable on the support surface 14 in any one of two directions, by making use of the single vacant position 22.

As FIG. 1 illustrates, the support surface 14 provides 16 predetermined locations, such as that identified in phantom at 22, at which the tiles 16 can be positioned. (In addition to the location 22, the other locations 22 are hidden from view in FIG. 1 by each of the tiles 16. It will be understood, however, that each of the predetermined locations underlies each of the tiles 16 in the positions shown.) As also illustrated, with respect to the predetermined location 22, each of the predetermined locations is provided with a pair of spaced contact terminals 24. And, although not specifically illustrated in FIG. 1 (but shown in FIG. 2, and schematically illustrated in FIG. 3) each tile 16 is provided with corresponding electrical contacts 42 positioned with respect to the tile 16 so that when the tile is moved into one of the predetermined locations 22, the electrical contacts 42 on the tile 16 will be registered with the contact terminals 24 on the support surface 14. As will be seen, each of the tiles 16 are equipped with a biasing structure that holds the associated electrical contacts of the tile away from the electrical contacts 24 of the support surface 14. The biasing structure permits each of the tiles 16 to be depressed, bringing the electrical contact 42 into electrical communication with the underlying contact terminals 24 of the support surface.

Housed within the frame 12 is a tone generator 50 (FIG. 3). and carried by each tile 16 is an electrical element having a predefined electrical property. In the preferred embodiment, as will be seen, this electrical property is a resistance. By depressing a tile to bring its associated electrical contacts into communication with the underlying (as viewed in FIG. 1) contact terminals 24 of the support surface 14 the characteristic is placed in circuit with the tone generator. initiating generation of a tone determined by the electrical characteristic carried by the tile 16.

The tiles 16 are formed and configured so that they are substantially identical to one another, except for the electrical property they carry, and they are devoid of any visual identification. Thus, the only way one can identify a particular tile 16 is by depressing it to produce a tone indicative of its electrical property.

Figure 2:
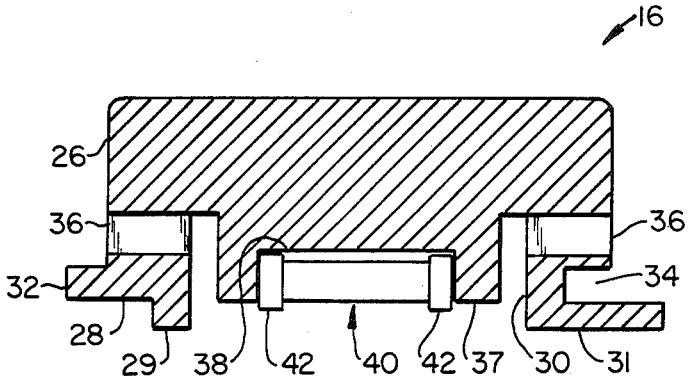
FIG. 2 is a cross-sectional representation of one of the array of tiles illustrated in FIG. 1.

Turning now to FIG. 2, the structure of each of the tiles 16 is illustrated. As shown, each of the tiles 16 includes a body portion 26 connected to support members 28 and 30 (which, in fact, are part of a unitary construction) by a resilient, compressible, coupling member 36. Although not specifically illustrated, it will be understood by those skilled in the art that the support members 28 and 30 provide the interlocking for the tiles 16 with support member 28 generally forming two sides of lower peripheries of the tile 16, and the support member 30 forming the other two. Each of the support members 28, 30 is configured to have support surfaces 29. 31, respectively, that ride on the support surface 14 of the frame 12 (FIG. 1). In addition, each of the support members 28 includes a laterally extending shoulder 34 configured and adapted to be received by a recess 34 formed in the support members 30 of each tile 16 in a manner that provides the interlocking features.

The support members 28 and 30 are attached to the body portion 26 of the tile 16 by the compressible coupling member 36 in a manner that holds the bottom portion 37 of the body member 26 away from the support surface 14. However, the compressible coupling member 36 allows the bottom portion 37 to be brought into close contact with the support surface 14 under finger-depressible action of the body member, for reasons that will become clear hereinafter.

Formed in the bottom portion 37 of the body member 26 is a recess 38 which receives and holds a resistance 40. Attached at the ends of the resistance 40 are a pair of electrical contacts 42, which also act as a holder for the resistance. When the body portion 26 is depressed by a user, the compressible coupling member 36 is compressed, permitting the bottom portion 37 to be brought into close proximity with the support surface 14. This places the electrical contacts 42 in electrical communication with the corresponding contact terminals 24 on the support surface 14, placing the resistance 40 in circuit with a tone generator housed within the frame 12.

Figure 3:
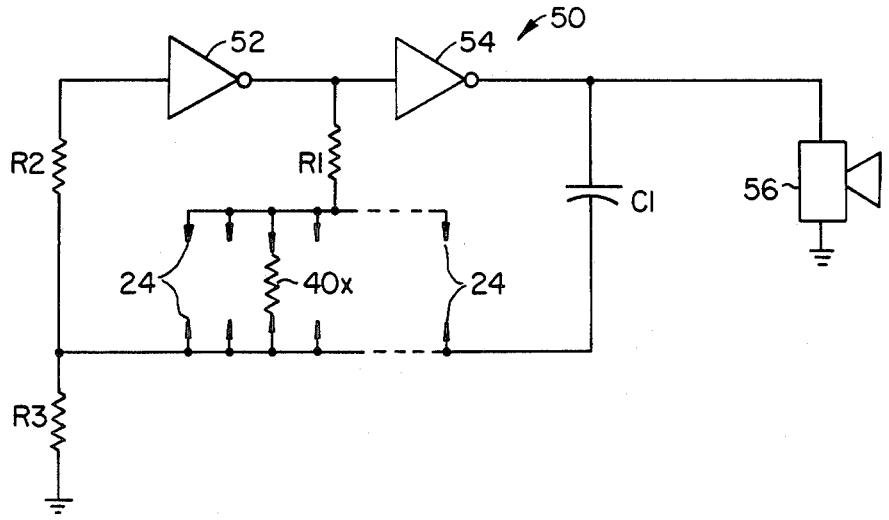
FIG. 3 is a schematic diagram of the tone generator circuitry housed within the frame structure of FIG. 1 and used to produce a tone.

Turning now to FIG. 3, the tone generator 50 of the present invention is illustrated. As shown, the tone generator 50 comprises a pair of complementary metal oxide silicon (CMOS) inverters, capacitance C1, resistors R1, R2 and R3, and a speaker 56 connected to the output of the inverter 54. Also illustrated in FIG. 3 are the plurality of pairs of contact terminals 24 formed at each of the sixteen (16) predetermined locations 22 on support surface 14. A resistance $40_x$ symbolizing one of the resistances 40 carried by the tiles 16, is shown removably inserted in circuit with the tone generator 50 by depressing the tile 16, as described above.

The tone generator 50 is a conventional astable multivibrator circuit configured for free-running operation at a frequency in the audio range. The frequency of operation is determined in large part by the inserted resistance $40_x$. Basically, the tone generator 50 operates as follows, Initially, the resistance $40_x$ is not in circuit, since the resilient coupling members 36 bias the resistance away from any of the electrical contacts 24. This being so, the input to the inverter 52 will be pulled toward ground via the current path formed by the resistances R2 and R3. The output of the inverter 52 will be HIGH and the output of the inverter 54 will, correspondingly, be LOW. The capacitor C1 is essentially discharged, and the tone generator 50 is, and will remain (until addition of the resistance $40_x$). in this quiescent state.

When one of the tiles 16 (FIGS. 1 and 2) is depressed to compress the compressible coupling member 36, assuming the tile is in one of the predetermined locations 22 so that the electrical contacts 24 are in registration with the electrical contacts 42 of the tile 16, the resistance $40_x$ will be placed in circuit as illustrated in FIG. 3. This produces a current path from the output of the inverter 52, and pulls the input of inverter 54 from a HIGH to a LOW. causing the output of inverter 54 to go HIGH. and charging the capacitor C1 in the positive direction.

When the input voltage, produced by the charging of the capacitor C1 gets to the threshold point of the inverter 52, the output of the inverter starts to to LOW and also drives the input to the inverter 54 LOW. which in turn drives the output of the inverter 54 HIGH. The charge on the capacitor can not change instantaneously, so the side of the capacitor C1 connected to resistor R3 jumps positive as well. This sudden jump, which is in the direction that the input to the inverter 52 is going, provides positive feedback, snapping the circuit into the alternate state, i.e., the output of the inverter 52 LOW, the input HIGH.

With the output of the inverter 52 LOW, and its input is HIGH. the capacitor C1 charges (through the resistance R1 and $40_x$) in the negative direction. This charging continues until the threshold is again reached, at which time the circuit snaps back into its original state: The output of the inverter 52 HIGH and the output of the inverter 54 LOW. This circuit continues to alternate between states as long as the resistance $40_x$ is in circuit.

When the tile 16 is released, the compressible coupling member 36 biases the body portion 26 away from the support surface 14, which removes the in-circuit connection of resistance $40_x$ from the tone generator 50. The tone generator 50 returns to its original or quiescent state.

As can be seen, the frequency of oscillation between the alternate states is determined by the rate at which the capacitor C1 is charged and discharged. This rate is established, in addition to the value of the capacitor C1, by the resistance through which the capacitor C1 is charged/discharged: that is, the resistance R1 and tile resistance $40_x$. Set forth below is a table of tile resistances for producing the tones of a (relative) A major scale, with the resistance R1 set at 10K ohms and resistance R3 set at approximately 100K ohms:

TABLE I

| NOTE | RESISTANCE($40_x$) |
|---|---|
| A | 10K |
| B | 7.5K |
| C# | 5.6K |
| D | 4.7K |
| E | 3.0K |
| F# | 1.8K |
| G# | 620 |
| A | 0 |

With these values, capacitor C1 is approximately 0.02 microfarads.

The resistance R2 operates to reduce variations of the tone generator 50 with power and temperature. The speaker 56 is of the piezo ceramic type, and operates to convert the electrical oscillations of the oscillator 50 to an audio tone. In addition a low voltage battery (approximately 3 volts DC - not shown) operates to supply power to the inverters 52. 54 via the optional ON/OFF switch 18 (FIG. 1).

Figure 4:
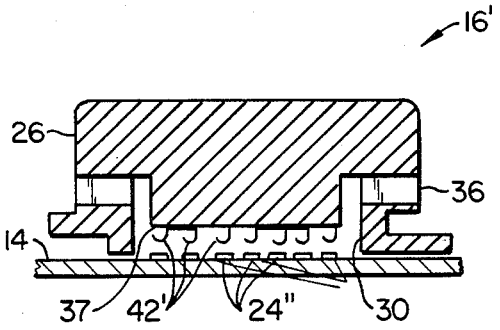
FIGS. 4 and 5 illustrate an alternate embodiment of the invention using a digital tone generator.
Figure 5:
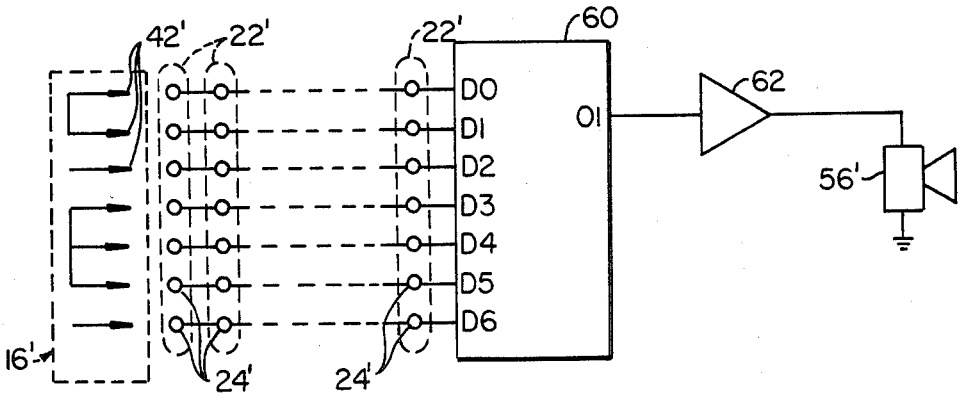

Referring now to FIGS. 4 and 5, an alternate embodiment of the invention is disclosed. Referring first to FIG. 4, there is shown a tile, designated with the reference numeral 16', having the same basic overall construction as that shown in FIG. 2 - with certain exceptions. Those exceptions are that the tile 16' does not have a recess formed in the bottom portion 37 of the body member 26 and does not carry a resistance 40. Further, rather than just a pair of electrical contacts 42, the tiles 16' each carry a number (here, seven) electrical contacts 42'. Similarly formed at each of the predetermined locations 22 on the support surface 14 is a similar number of contact terminals 24'. The contact terminals 24' (as are the electrical contacts 42') are spaced and positioned so that when the tile 16' is moved into the predetermined location 22, the electrical contacts 42', carried by the tile 16, are in registration with the contact terminals 24' carried on the support surface 14.

Referring now to FIG. 5, a sound generator is shown in the form of a digital sound synthesizing circuit 60 having data inputs Dϕ, D1, . . . D6 and an output O1 connected to the input of an amplifier 62. The output of the amplifier drives a piezo ceramic speaker 56'.

The inputs Dϕ–D6 of the digital sound synthesizer 60 are each series-connected to corresponding contact terminals 24'. As FIG. 5 diagrammatically illustrates. each of the seven contact terminals 24' at each predetermined location 22' is connected to its counterpart contact terminal 24' in the other predetermined locations 22' and to a corresponding data input Dϕ, . . . D6 of the digital sound synthesizer 60. As FIG. 5 also illustrates, the tiles 16' can be moved into any one of the predetermined locations 22' and the body portion depressed to place the electrical contacts 42' carried by the tile in circuit with the digital sound synthesizer 60.

As illustrated in FIG. 5, the electrical contacts 42' form an electrical property composed of a coded pattern by shorting one or more of the electrical contacts 42' variously together, leaving others of the electrical contacts 42' unconnected. In this manner, each tile 16' can be uniquely identified and distinguished from the others, by this technique.

Referring specifically to FIG. 5, if the tile 16' is depressed, the electrical contacts 42' associated therewith will short the data inputs Dϕ, D1 together, and D3, D4, D5 together, while the data inputs D2 and D6 are left to float. The digital sound synthesizer 60 has sufficient intelligence to determine the pattern applied to its inputs by applying a signal to one data input and checking the others to see if the applied signal appears thereat. If so, the inputs are connected together; if not, they are not connected together. Accordingly, the digital sound synthesizer 60 determines the pattern carried by the tile 16' and from that pattern determines the frequency of the signal to be generated at the output 01 thereof. Whatever frequency is generated is applied to the amplifier 62 and to the speaker 56' generating a tone.

Of course, each of the tiles 16' used to incorporate the alternate embodiment of the invention would preferably have different patterns of connections of the electrical contacts 42' so that each would generate a tone unique to that tile, and identifying that tile.

Figure 6:
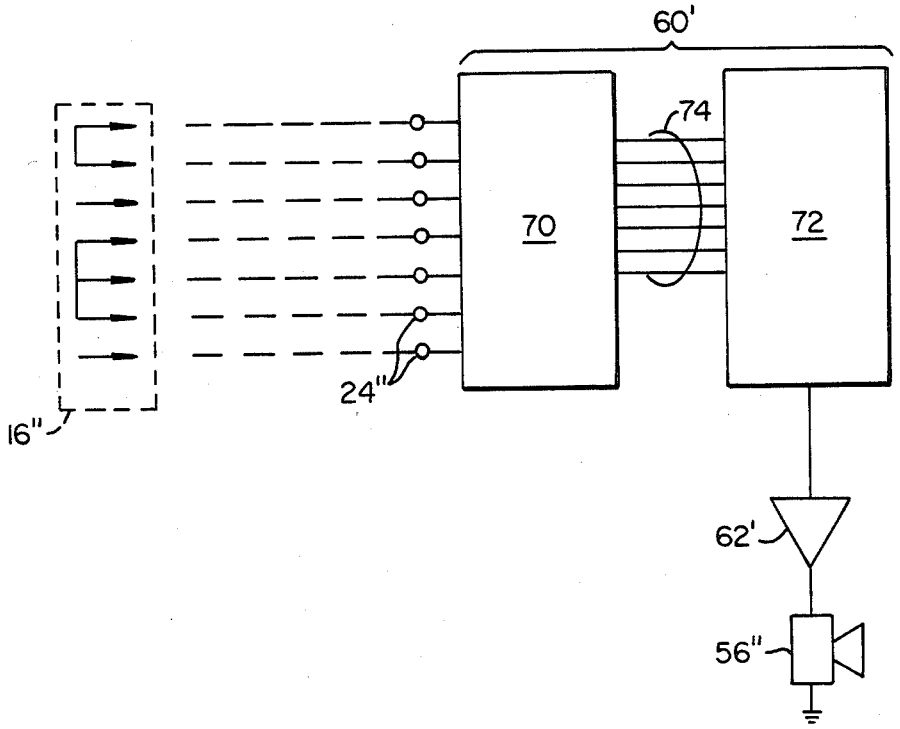
FIG. 6 illustrates an alternate embodiment in which speech synthesis apparatus is used.

FIG. 6 illustrates yet another embodiment of the invention. Here, the tiles 16'' can be constructed substantially like that shown and discussed with respect to FIG. 5. In this embodiment, however, the sound generator 60' forms a speech synthesizer, comprising a decoder unit 70 and a synthesizer unit 72. The decoder can be, for example, a COP 431 microprocessor, manufactured by National Semiconductor (although it may also be implemented by a gate array circuit specifically designed for the purpose) to perform the task of decoding the shorted pads of the tile 16''. The synthesizer unit 72 can be implemented by using a device sold by NEC Electronics and identified by the part number uPD 7755.

In operation, the tile 16'' is depressed by a user, as described above. The decoder unit samples the contact terminals 24'' to determine electrical property (i.e., identity) of the depressed tile. It then encodes the determined identity, and communicates that identity to the synthesis unit 72 via a connecting bus 74. Depending on the information received by the synthesizer 72, a word is synthesized and orally produced by the speaker 56''. The synthesizer unit 72 can be programmed with a number of words, each activated by a different tile. The object of a game, for example, could be to arrange the tiles to form an intelligible sentence when depressed in a particular manner.

In summary, there has been disclosed a puzzle of the type incorporating an array of tiles enclosed and supported by a frame and support surface. The tiles are movable upon the support surface in at least two directions to predetermined locations thereon. Each of the predetermined locations includes electrical contacts connected to a tone generator housed within the frame structure. Each of the tiles carries circuit elements that provide the tile with an electrical characteristic different from that of the other tiles. Means are provided for placing the electrical characteristic in circuit with the tone generator to use a tone indigenous to the electrical characteristic and identifying the tile.

It should be obvious to those skilled in the art, however, in light of this disclosure, that there exist still further embodiments and modifications of the invention. For example, the familiar "RUBIK S CUBE" game, of the type in the form of a large cube having movable members in the form of smaller cubes, can be adapted to include the disclosed invention so that pressing exposed surfaces of each cube will cause a unique word to be produced. The object can be to get the cubes on a particular face of the large cube to "say" the same word.

Another form the present invention can take is to configure the frame structure as a large musical staff. "Tiles", in the form of musical notes, can be placed at locations on the staff-like frame and depressed to produce a tone associated with the placement.

Finally, although the invention disclosed discusses using a sound generator for producing tones of speech, it should now be apparent that other sound effects can be utilized without departing from the scope and spirit of the invention, such as, for example, dog barks, duck quacks, or frog croaks.

I claim:

1. A puzzle, comprising:

a rectangular array of title members enclosed in a frame structure, each of the title members having an electrical property;

tone-generating means housed in the frame structure; and means for selectively placing the electrical property of one or more of the title members in circuit with the tone-generating means to produce a sound having a characteristic determined by the electrical property carried by the title member that identifies such tile member and distinguishes it from other of the tile members.

2. The puzzle of claim 1, each of the tile members being formed and configured to be visually indistinguishable from the other of the tile members.

3. The puzzle of claim 1, wherein the electrical property is resistance.

4. The puzzle of claim 3, the frame structure including a support surface to support the tile members for movement thereon, the support surface defining a number of predetermined locations at which respective ones of the tile members can be positioned, the placing means including contact terminals formed on the support surface at least one of the predetermined locations and coupled to the tone-generating means, each of the tile members having electrical contacts for removable engagement with the contact terminals and electrically coupled to the electrical property of the tile member.

5. The puzzle of claim 1, each of the tile members being finger-depressible to cause the electrical property associated with such tile member in circuit with the tone-generating means.

6. The puzzle of claim 1, wherein the electrical property for each tile member is a plurality of electrical contacts predetermined ones of which being electrically shorted together to form a coded pattern.

7. The puzzle of claim 6, wherein the tonegenerating means includes means for decoding the coded pattern of each of the tile members when placed in circuit therewith.

8. A sound-producing puzzle, comprising:

a frame structure;

a plurality of movable elements supportable by the frame structure and operable to be placed at a number of predetermined locations relative to the frame structure;

sound-generating means operably associated with each of the predetermined locations for producing a sound that identifies selected ones of the plurality of movable elements and distinguishes each selected one from other of the selected ones when located in any one of the predetermined locations.

9. The puzzle of claim 8, the movable elements being supported by the frame structure for movement in a plane.

10. The puzzle of claim 9, wherein each of the movable elements is formed and configured to be substantially visually indistinguishable from one another.

11. The puzzle of claim 8, wherein each of the movable elements includes an electrical property different from that of at least certain of the other movable elements and including means for removably placing the electrical property in circuit with the sound-generating means for producing a tone having a pitch determined at least in part by the electrical property.

12. The puzzle of claim 11, wherein the tonegenerating means includes an astable multivibrator.

13. The puzzle of claim 12, wherein the electrical property is a resistance.

14. A puzzle of the type having a plurality of elements locatable on a frame structure along predetermined paths to a number of predetermined positions, the improvement comprising:

each of the plurality of elements having first circuit means for providing the element with a predetermined electrical property that identifies the element and distinguishes it from other of the plurality of elements;

sound-generating means housed in the frame for producing sound;

second circuit means associated with at least certain of the predetermined positions and coupled to the sound-generating means; and each of the plurality of elements having means operable by a user to place the first and second means in electrical communication with one another when any one of the elements is moved to any of the predetermined positions, the sound produced by the sound-generating means having a characteristic determined by the electrical property.

15. The improvement of claim 14, wherein the sound produced by the sound-generating means is a tone.

16. The improvement of claim 14, wherein the sound produced by the sound-generating means is speech.

17. The improvement of claim 14, wherein the sound produced is a duck quack.

18. A puzzle, comprising:

a frame structure;

a plurality of elements supported by the frame structure, each element being movable along predetermined paths to a number of different predetermined locations relative to the frame structure, each of the plurality of elements having circuit means for providing such element with an electrical characteristic, the electrical characteristic of each of certain of the plurality of elements being different from the other of the certain of the plurality of elements;

sound-generating means; and means associated with at least two of the number of locations for coupling the electrical characteristic associated with a one of the elements in circuit with the sound-generating means when the one element is moved to the one location;

whereby, the sound-generating means is operable to produce sound having a property determined by the electrical characteristic associated with the one element in circuit.

* * * * *